US005411115A

United States Patent [19]

Shropshire

[11] Patent Number: 5,411,115

[45] Date of Patent: May 2, 1995

[54] OIL DRAIN PLUG

[76] Inventor: Alan Shropshire, 220 Oak St., Gilbertsville, Pa. 19525

[21] Appl. No.: 206,707

[22] Filed: Mar. 7, 1994

[51] Int. Cl.[6] ..... F16C 3/14; F16N 33/00

[52] U.S. Cl. ..... 184/1.5; 251/100

[58] Field of Search ..... 251/144, 324, 334, 95, 251/100; 184/1.5

[56] References Cited

U.S. PATENT DOCUMENTS

| | | | |
|---|---|---|---|
| 1,158,401 | 10/1915 | Empson | 251/100 |
| 1,463,735 | 7/1923 | Varrieur | 251/100 |
| 3,103,947 | 9/1963 | Mueller | 251/144 |
| 3,537,679 | 11/1970 | McCarthy et al. | 251/144 |
| 3,698,420 | 10/1972 | Grundy et al. | 251/144 |
| 4,351,355 | 9/1982 | Koller et al. | 251/144 |
| 4,745,894 | 5/1988 | Laipply et al. | 123/196 |
| 4,776,430 | 10/1988 | Rule | 184/1.5 |
| 4,813,134 | 3/1990 | Rabalais | 184/1.5 |
| 4,977,978 | 12/1990 | Batrice | 184/1.5 |
| 5,096,158 | 3/1992 | Burdick et al. | 251/144 |
| 5,259,588 | 11/1993 | Crosby, Jr. et al. | 251/324 |

FOREIGN PATENT DOCUMENTS

| | | | |
|---|---|---|---|
| 1155487 | 5/1956 | France | 251/100 |
| 530811 | 12/1955 | Italy | 251/100 |
| 322894 | 12/1929 | United Kingdom | 251/100 |
| 324768 | 2/1930 | United Kingdom | 251/100 |
| 858717 | 1/1961 | United Kingdom | 251/100 |

*Primary Examiner*—Thomas E. Denion
*Attorney, Agent, or Firm*—Henderson & Sturm

[57] ABSTRACT

An improved oil drain plug for engines and other machinery has a bored, generally cylindrical, first part with a threaded outer portion adapted to be inserted into an existing oil drain hole. A second, sealing part fits within the first and partially extends below it with a surface adapted to allow it to be manipulated in relation to the first. A pair of hooked slots on the first portion cooperate with a pair of protruding members on the second to form a "push and twist" type of engagement that allows a closed and opened configuration to be maintained by the device. A spout member is present on the first portion to allow the connection of a hose or tube for the convenient drainage of the oil into a container.

3 Claims, 2 Drawing Sheets

OIL DRAIN PLUG

REFERENCE TO RELATED PUBLICATIONS

The present invention was registered in the United States Patent and Trademark Office under the Document Disclosure Program. The date received was Aug. 10, 1993 and the registration number is 336,928.

BACKGROUND OF THE INVENTION

1. Field of the Invention

The present invention relates to oil drains on internal combustion engines. More specifically, it relates to oil drain plugs on the bottom of the oil pans on vehicles. Even more specifically, it relates to an oil pan drain plug where the conventional drain plug is replaced with two interengaging portions. These portions constitute an "open" and a "closed" position alternated through by a "push and twist" type engagement. When in the open engagement, a spout on the upper portion is put into fluid communication with the interior of the vehicle oil pan and allows for the attachment of a hose or the like to facilitate the draining of the oil from the vehicle with little or no mess.

The unique drain plug of the instant invention could be applied in many other fields where it is required to periodically drain a liquid from a holding tank. Hydraulic fluid reservoirs are but one example. The artisan could see many other applications as, for example, the providing of a simple means to drain an aquarium. Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In the maintenance of various vehicles, one of the most important schedules that must be observed is the regular changing of the engine oil. Many people, instead of taking the car or truck to a garage, prefer to do this operation themselves, since it is relatively uncomplicated. On almost all passenger and commercial vehicles, the plug that is used for draining the oil is located at the lowest point of the oil pan of the vehicle so that gravity can be utilized to completely empty the engine compartment of the used oil. This means that the person wishing to change the oil first crawls under the car and then loosens and removes the oil plug. As the plug is loosened, oil starts flowing first around the spaces between the threads and then, as the plug is completely freed, pours out and downwards. As many manufacturers recommend that the engine be warm when this operation is being performed (to decrease the viscosity of the oil), there is a chance of the person miscalculating the "cool down" time necessary and burning themselves on the hot fluid. Additionally, the oil may spill or be splashed over the ground surface beneath the vehicle, providing for both a clean up problem and an environmental hazard should the oil be washed into a water supply, storm drain, lawn, etc.

The present invention seeks to ameliorate this situation by providing an improved oil drain plug that will stay permanently attached to the vehicle and that has an open and closed position. Additionally, the device includes a spout adapted to allow a rubber or plastic hose to be fit over it, thus allowing the oil to be drained off without the need of special equipment. During a search conducted in this art, the following patents were uncovered:

First, in U.S. Pat. No. 4,745,894 issued on May 24, 1988 to Robert A. Laipply, et al. there is disclosed an oil drain where a body threaded into the conventional drain hole has an axial bore therein. A hollow deformable seal cap is inserted through this bore to protrude into the oil pan itself and is held sealing the pan off with a biasing spring. When the oil pan needs to be drained, the protective cap is removed and a probe is inserted that engages a ball detent apparatus that forces the spring to expand, extending the seal member into the oil pan and putting exterior of the same into fluid communication with the exterior.

In U.S. Pat. No. 4,776,430 issued on Oct. 11, 1988 to Morris M. Rule there is disclosed a crankcase draining device wherein a first portion of the device is a ball check valve inserted into the drain plug opening. This consists of a spherical member biased into firm contact with an O-ring type seal. When it is desired that the oil be drained, a second portion is attached to the first and a pump is attached to both. The vacuum under the ball member, draws it downwardly away from the O-ring, allowing the oil to be drawn from the crankcase.

U.S. Pat. No. 5,197,567 issued on Mar. 30, 1993 to Keith J. Rabelais discloses a replacement drain hole closure wherein a pivoted clamping member is inserted through the drain hole on a threaded member. A sealing member is attached to the other end of the threaded portion and, by rotating the sealing member, the clamping member is brought into contact with the interior of the oil pan thus clamping the sealing member on the exterior of the drain hole. Reverse rotation will then open the hole, allowing the oil to be drained from the crankcase.

Lastly, U.S. Pat. No. 4,997,978 issued on Dec. 18, 1990 to Mazen P. Batrice, discloses an oil change apparatus wherein a key-operated drain valve located generally at the bottom periphery of the vehicle is attached by a flexible tube to the drain hole of the oil pan. A power assisted change means with a pump is discussed as the method of withdrawing the oil.

None of the above inventions and patents, taken either singly or in combination, is seen to describe the instant invention as claimed.

SUMMARY OF THE INVENTION

The present invention is an improved oil drain plug with a bored, generally cylindrical, first part with a threaded outer portion adapted to be inserted into an existing oil drain hole. A second sealing part fits within the first and partially extends below it with a surface adapted to allow it to be manipulated in relation to the first. A pair of hooked slots on the first part cooperate with a pair of protruding members on the second to form a "push and twist" type of engagement that allows a closed and opened configuration to be maintained by the device. A spout member is present on the first part to allow the connection of a hose or tube for the convenient drainage of the oil into a container.

Accordingly, it is a principle object of the invention to provide an improved oil drain wherein fluid communication can be made between the interior and exterior of the oil pan with a simple hand manipulation that requires no special tools.

It is another object of the invention to provide an improved oil drain wherein the spewing oil is directed away from the hand of the user manipulating the device.

It is another object of the invention to provide an improved oil drain wherein when the device is in an open position, a tube or hose can be attached to a spout member on the device to obviate any potential mess that could occur during the draining operation.

It is a further object of the invention to provide an improved oil drain that would fit on a variety of vehicles, machines, or any device that incorporates an oil sump such as found on an internal combustion engine.

Another object of the invention is to provide an improved oil drain which does not separate from the machine during use, so as to eliminate the possibility of loss or damage to the plug device.

It is a major goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
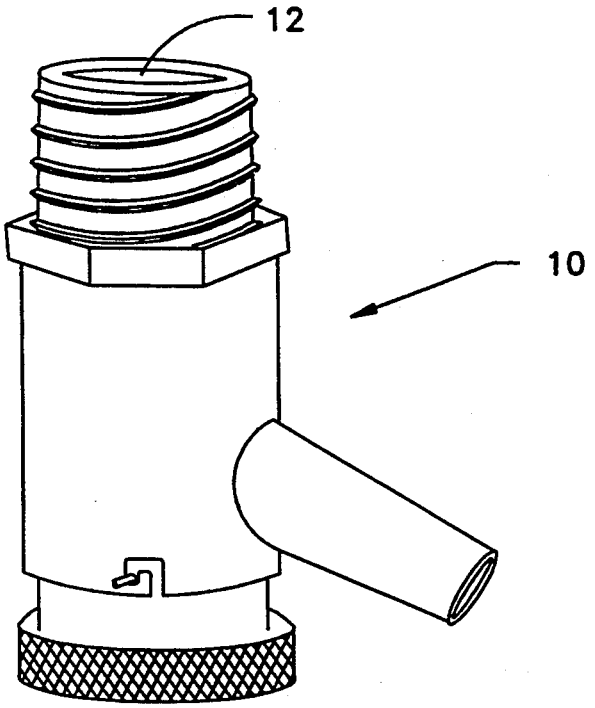
FIG. 1 is a perspective view of the present invention.
Figure 2:
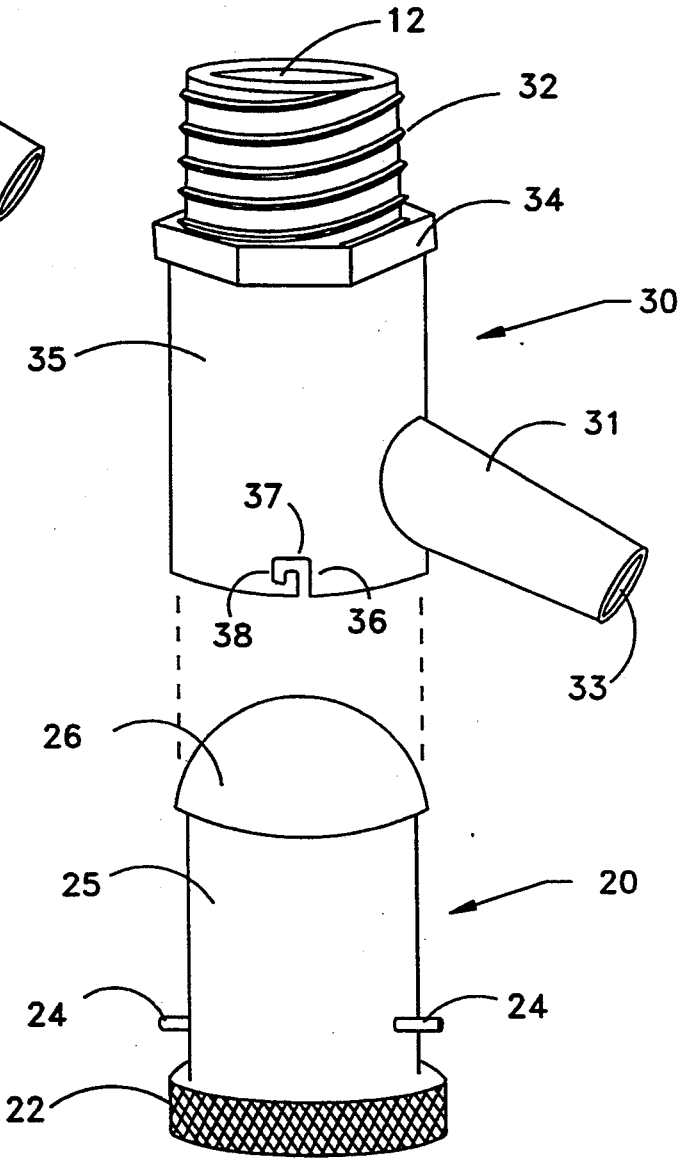
FIG. 2 is an exploded perspective view of the present invention showing the first and second portions of the device.
Figure 3:
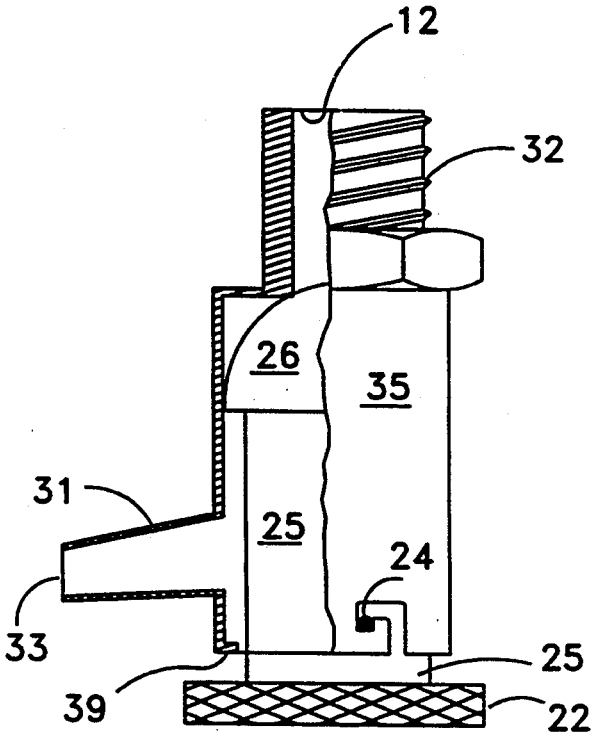
FIG. 3 is a partial cutaway view of the device in a closed configuration.

The present invention is indicated generally at 10 in FIG. 1. Referring to FIGS. 1 and 2, the improved plug 10 has a first portion 30, which is adapted to be inserted into the oil drain plug of the engine. This is accomplished by means of the threaded portion 32, sized and configured to fit into the drain plug hole (not shown), replacing the conventional plug (also not shown) and using securement means adapted to be manipulated by a conventional tool such as the hexagonal flats 34 in FIG. 2. The first portion 30 has an outer body portion 35 with an axial bore extending therethrough, as will be discussed further. Additionally, the first portion 30 has a pair of hooked slots 37. It should be noted that in the figures only one of the slots 37 is visible, it is understood that the other slot, oppositely and laterally disposed, is identical. The second sealing portion 20 has a generally cylindrical main body 25, a pair of protruding members 24, a grip portion 22, and a sealing bulb portion 26 affixed at the main body 25 end distal to the grip portion 22. The sealing bulb portion 26 is, in this embodiment, made of a deformable material, such as a heat resistant rubber, that will allow it to be inserted past the lower lip 39 of the first portion 30, shown in FIGS. 3 and 4.

The discussion turns now to the operation of the improved drain plug 10. As was discussed above, the first portion 30 is threaded into the drain hole (not shown) of the engine by means of the threaded portion 32. If desired, the first portion could then be soldered or otherwise sealed into place, as the present invention is envisaged as a long-term or permanent replacement. The second sealing portion 20 is then placed such that the bulb portion 26 is within the main body portion 35, as discussed above. The protruding members are inserted into the slots 37, first through the first slot portion 36, and then over and into the locking slot portion 38, so that the device 10 is in the closed position shown in FIG. 3. As can be seen, the bulb portion 26 completely covers the necked down portion of the axial bore 12 within the threaded portion 32 of the first portion 30, preventing the leakage or drainage of oil from the crankcase. The peripheral edge of the bulb portion 26 should be in slightly deformed contact with the wider portion of the axial bore 12; that is, the portion of the bore 12 that passes through the main body 35 of the portion 30. This creates enough friction to keep the device 10 from accidentally moving into the opened position from vibration or incidental contact. Additionally, it should be noted that the slots 37 are configured such that the bulb portion 26 must be pressed very firmly against the bore 12 as it proceeds into the necked down portion within the threaded extension 32 before the protruding members can be manipulated into the locking areas 38 of the slots 37. This would bias the members 24 downward in the locking areas 38, further decreasing the likelihood of accidental opening. Thus placed, it is contemplated that the device 10 would extend only about three quarters of an inch from the bottom (or side in some cases) of the oil pan. This distance would be small enough to ensure that the "bottoming out" of the vehicle would be unlikely to shear or distort the device 10.

Figure 4:
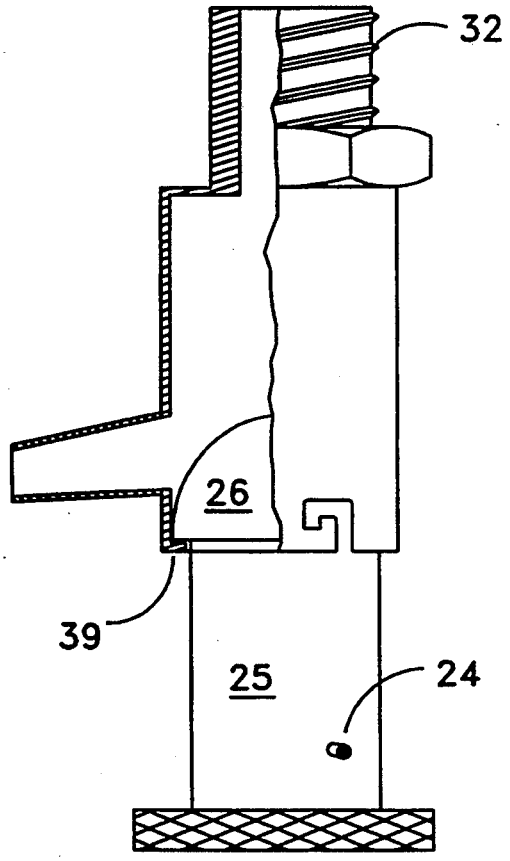
FIG. 4 is a partial cutaway view of the device in an open configuration.

When the user wishes to drain the oil from the engine, he simply grips area 22 and manipulates the second sealing portion 20 so that the members 24 are moved upward, over, and downwards into and past the first slot section 36 of slot 37, to the position shown in FIG. 4. In this position the oil is free to flow into the spout portion 31 and out through the nozzle opening 33. Nozzle 31 extends a sufficient distance out from main body 35, and narrows towards the opening 33 to allow for the attachment of a hose or tube (not shown) so that the user can direct the flow of oil into any convenient container. It is also contemplated that a small plastic screw or plug could be inserted into the nozzle opening 33 as a backup precaution against the accidental opening of the device. This screw or plug could be attached with a short section of plastic in a loop around the device 10 to prevent it from being inadvertently lost.

Figure 5:
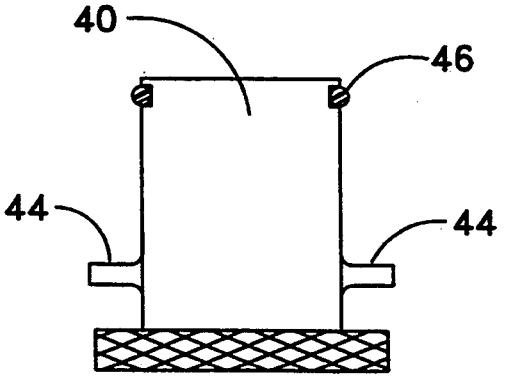
FIG. 5 is a view of an alternative embodiment where the second, sealing portion has an O-ring type seal.

Turning to FIG. 5, there is seen an alternative embodiment of the device 10 where the second sealing portion 40 shown therein has, instead of the bulb 26 specified in the first embodiment, a circumferential O-ring type seal 46 extending around the upper end of the portion 40. The protruding members 44 are substantially the same as members 24 in the first embodiment.

I claim:

1. An improved drainage plug for draining oil from the existing oil drainage hole in an engine consisting of:

a first portion, said first portion having a stepped axial bore extending therethrough, said axial bore having an upper reduced diameter neck portion and an enlarged diameter lower portion, said axial bore forming an outer wall, and having an upper fluid inlet and a lower open end, and said first portion including threaded means for attaching said first portion to said existing oil drainage hole such that fluid communication is established between said oil drainage hole and said axial bore;

an outwardly and downwardly projecting tapered fluid outlet formed in said outer wall, in open fluid communication with said axial bore, intermediate said fluid inlet and said lower open end;

a second generally cylindrical portion dimensioned to be axially received in said lower portion of said first portion and further including an enlarged arcuate resilient sealing means having a crown dimensioned to sealingly engage the reduced diameter neck portion and having a peripheral edge portion dimensioned to sealingly engage the enlarged diameter lower portion of said first portion; and adjustable engagement means allowing for the selective positioning of said sealing means at predetermined positions within said axial bore, such that said sealing means may be manipulated by said adjustable engagement means to a first position wherein said sealing means is positioned within said axial bore between said fluid outlet and the oil drainage hole, and where said sealing means may be further manipulated by said engagement means to a second position where fluid communication exits between the oil drainage hole, said axial bore, and said fluid outlet; whereby, in said first position no oil passes through said fluid outlet and in said second position, oil is free to pass therethrough; wherein, said adjustable engagement means cooperating slots and protruding members located on said first and second portions, whereby the crown of said resilient sealing means must first be forcibly deformed and then relaxed to engage the sealing means in said first position, then counter-rotated while being forcibly deformed, then relaxed and withdrawn relative to said portion to dispose said sealing means in said second position.

2. The improved drainage plug as claimed in claim 1 wherein said slots are located within said outer wall of said first portion, and said protruding members are located on said second portion.

3. The improved drainage plug as claimed in claim 1 wherein said enlarged sealing means is a deformable bulb mounted on one end of said second portion.

* * * * *